US006720732B2

(12) United States Patent
Kao et al.

(10) Patent No.: US 6,720,732 B2
(45) Date of Patent: Apr. 13, 2004

(54) BARRIER RIB STRUCTURE FOR PLASMA DISPLAY PANEL

(75) Inventors: Hsu-Pin Kao, Ping Chen (TW); Yi-Sheng Yu, Taoyuan (TW); Ching-Hui Lin, Taoyuan (TW); Kuang-Lang Chen, Chungli (TW); Sheng-Chi Lee, Taipei (TW)

(73) Assignee: Chunghwa Picture Tubers, Ltd., Taipei (TW)

( * ) Notice: Subject to any disclaimer, the term of this patent is extended or adjusted under 35 U.S.C. 154(b) by 0 days.

(21) Appl. No.: 10/106,494

(22) Filed: Mar. 27, 2002

(65) Prior Publication Data

US 2003/0184228 A1 Oct. 2, 2003

(51) Int. Cl.[7] ..... H01J 17/49

(52) U.S. Cl. ..... 313/587; 313/582; 313/495; 313/587; 313/292

(58) Field of Search ..... 313/582, 495, 313/292, 587

(56) References Cited

U.S. PATENT DOCUMENTS

| | | | | | |
|---|---|---|---|---|---|
| 5,825,128 | A | * | 10/1998 | Betsui et al. | 313/582 |
| 6,008,582 | A | * | 12/1999 | Asano et al. | 313/582 |
| 6,124,676 | A | * | 9/2000 | Salavin et al. | 315/169.4 |
| 6,373,195 | B1 | * | 4/2002 | Whang et al. | 315/169.3 |
| 6,376,986 | B1 | * | 4/2002 | Takagi et al. | 313/582 |
| 6,392,344 | B1 | * | 5/2002 | Hong | 313/586 |
| 6,414,433 | B1 | * | 7/2002 | Moore | 313/582 |
| 6,495,967 | B2 | * | 12/2002 | Kao et al. | 315/169.4 |
| 6,531,820 | B1 | * | 3/2003 | Lee et al. | 313/586 |
| 2002/0130620 | A1 | * | 9/2002 | Jeong et al. | 313/586 |

* cited by examiner

*Primary Examiner*—Vip Patel
*Assistant Examiner*—Holly Harper

(57) ABSTRACT

A barrier rib structure for a plasma display panel is described. The barrier rib structure formed on a back substrate has a plurality of parallel barrier ribs. Each barrier rib has a plurality of nodes composed of two side-expanded trapezoid bulges. The barrier ribs are arranged according to the nodes to form a plurality of discharge spaces between the barrier ribs and a plurality of gas channels between the nodes to connect the discharge space.

20 Claims, 8 Drawing Sheets

BARRIER RIB STRUCTURE FOR PLASMA DISPLAY PANEL

FIELD OF THE INVENTION

The present invention relates to a plasma display panel (PDP), and more particularly to a barrier rib structure for preventing error discharge and improving luminescence efficiency.

BACKGROUND OF THE INVENTION

Plasma display panels (PDP) can be divided into two types, the direct current (DC) type and the alternating current (AC) type, according to their electrical driving mode. In FIG. 1, which illustrates a conventional AC-type PDP, glass plates 11, 12 undergo several manufacturing steps in which many functional layers are formed thereon and are then combined together by sealing the periphery of the glass plates 11, 12. A mixed gas with a predetermined ratio is then introduced into the discharge units between the glass plates 11, 12.

In FIG. 1, a plurality of parallel transparent electrodes 111 and bus electrodes 112, a dielectric layer 113 and a protective layer 114 are sequentially formed on the glass plate 11, hereinafter referred to as front plate 11. Similarly, a plurality of parallel address electrodes 121, a plurality of parallel barrier ribs 122, a fluorescencer 123 and a dielectric layer 124 are formed on the glass plate 12, hereinafter referred to as back plate 12. One transparent electrode 111 on the front plate 11 and one address electrode 121 on the back plate 12, transparent electrode 111 and address electrode 121 being perpendicularly crossed, compose a discharge unit. When a voltage is applied to a specific discharge unit, gas discharge occurs at the discharge unit between the dielectric layers 113 and 124 to induce emission of a colored visible light from the fluorescencer 123.

FIG. 2 is a schematic, cross-sectional view corresponding to FIG. 1. In a conventional AC-type PDP 10, referring to FIGS. 1 and 2 simultaneously, a plurality of parallel-arranged transparent electrodes 111 are formed on the front plate 11. Each of the transparent electrodes 111 correspondingly has a bus electrode 112 to reduce linear resistance of the transparent electrodes 111. In one discharge unit 13, a three-electrode structure, including an X electrode and an Y electrode of the transparent electrode 111 on the front plate 11 and an address electrode 121 on the back plate 12, is generally employed. When a voltage is applied to the above three electrodes of a specific discharge unit 13 to induce discharge, the mixed gas in the discharge unit 13 glows ultraviolet (UV) rays to light the fluorescencer 123 inside the discharge unit 13. The fluorescencer 123 then emits a visible light, such as a red (R), green (G) or blue (B) light. An image is thus produced by scanning the discharge unit array.

In the conventional AC-type PDP 10, the barrier ribs 122 are arranged in parallel strips on the back plate 12. The address electrode 121 between two adjacent barrier ribs 122 is disposed inside the dielectric layer 124. In the structure, the fluorescencer 123 can only be coated on the sidewalls of the barrier ribs 122 and the top surface of the dielectric layer 124, so that only three planes are utilized. In each discharge unit 13, the fluorescencer 123 is coated on a small surface area, so that a low luminescence efficiency is obtained in the conventional PDP 10.

Since an erroneous discharge may occur in a non-discharge unit 13*a*, illustrated in FIG. 3, of the conventional AC-type PDP 10, the distance d between two adjacent discharge units 13 must be increased to prevent the same. Although a larger non-discharge unit 13*a* prevents erroneous discharge, discharge units 13 are then relatively contracted, i.e. have a reduced opening ratio, and luminescence efficiency is thus decreased. Conversely, a smaller non-discharge unit 13*a* provides larger discharge units 13, but erroneous discharge then readily occurs, so that neighboring discharge units 13 are affected during operation.

In addition, no isolation is provided between the discharge region A and non-discharge region B and erroneous discharge thus readily occurs in the non-discharge region B. A conventional method for solving the erroneous discharge issue in non-discharge region B is to perform an additional treatment of forming black strips to shade a light produced in the non-discharge region B. The contrast of the conventional PDP 10 is therefore increased, but further manufacture cost is incurred.

To solve the foregoing described problems, several different kinds of barrier rib structure have been developed by PDP designers and manufacturers. For example, Pioneer Company provides a Waffle structure having sealed latticed barrier ribs. The fluorescencer can be coated on the five planes of each discharge unit, i.e. front, back, left, right and bottom planes, thereby improving luminescence efficiency by increasing the fluorescencer coating area. At the same time, each discharge unit becomes a closed space and this effectively prevents erroneous discharge in non-discharge units. Unfortunately, the closed discharge units result in greater difficulties when vacuuming and refilling gas during the manufacturing processes.

SUMMARY OF THE INVENTION

According to the above descriptions, for the barrier rib structure of a conventional PDP, many drawbacks occur; for example, the structure is prone to erroneous discharge, the luminescence efficiency is low, or the structure is hard to vacuum. Therefore, the present invention provides a barrier rib structure for a plasma display panel (PDP) that can resolve above problems.

It is an object of the present invention to provide a barrier rib structure where a plurality of nodes composed of two side-expanded trapezoid bulges are designed in non-discharge regions of barrier ribs to form small gas channels between the nodes. The small gas channels can inhibit unsuitable discharges in non-discharge regions during gas discharging to prevent erroneous discharge. Moreover, by controlling erroneous discharge, the margin of driving voltage can be increased, so that the yield of products can be improved. Furthermore, the small gas channels in non-discharge regions are helpful to gas purging and refilling during manufacture of a PDP device.

It is another object of the present invention to provide a barrier rib structure where a plurality of nodes composed of two side-expanded trapezoid bulges are designed in non-discharge regions of barrier ribs. The error discharge problem can be effectively prevented, so that the area of non-discharge regions can be diminished to increase the area of discharge regions. Therefore, the opening ratio can be increased, and the luminescence efficiency can be improved. The trapezoid bulges of the present invention add four tilted planes at the corners of each discharge unit. Accordingly, the fluorescencer coating area of each discharge unit is increased, and thus the luminescence efficiency is improved.

It is a yet another object of the present invention to provide a barrier rib structure that forms an almost closed discharge space to constrict energy in the discharge space as well as gas discharge, and this structure is helpful in utilizing gas discharge energy. Furthermore, the corners of the discharge space are designed as inclined planes or arced planes that improve uniform reception of ultraviolet rays by the fluorescencer to increase luminescence from the fluorescencer.

It is a further object of the present invention to provide a barrier rib structure that further comprises an isolation wall adjacent to a purge hole. The isolation wall is perpendicular to the gas channels to stop the gas from flowing straight into the purge hole, so that local disturbed gas flow can be minimized to prevent damage to the barrier ribs adjacent to the purge hole.

In one aspect, the present invention provides a barrier rib structure on a back substrate for a plasma display panel. The structure at least comprises a plurality of barrier ribs. Each barrier rib has a plurality of nodes in series composed of two side-expanded trapezoid bulges. The barrier ribs are in a parallel arrangement corresponding to the nodes to form a plurality of discharge spaces between the barrier ribs and a plurality of gas channels between the nodes. The gas channels connect neighboring discharge spaces.

In another aspect, the present invention provides a gas discharge luminescent structure for a plasma display panel. The structure at least comprises a first dielectric layer, a plurality of barrier ribs, a fluorescent layer and a second dielectric layer. The first dielectric layer has a plurality of parallel address electrodes therein. The barrier ribs are formed on the first dielectric layer, and respectively disposed between the address electrodes. Each barrier rib has a plurality of nodes in series comprising two side-expanded trapezoid bulges. The barrier ribs are in a parallel arrangement corresponding to the nodes to form a plurality of discharge spaces between the barrier ribs and a plurality of gas channels between the nodes. The fluorescent layer is coated on the inside wall of the discharge space. The second dielectric layer is located on the barrier ribs to seal the discharge space. The second dielectric layer has a plurality of parallel transparent electrodes therein. The transparent electrodes and the address electrodes cross in the discharge space.

The transparent electrode can comprise an X electrode and an Y electrode. Each of the X and Y electrodes has a bus electrode, respectively. By applying a voltage to these electrodes, a mixed gas sealed into the discharge space generates ultraviolet rays to light the fluorescent layer such that the fluorescent layer emits the desired colored visible light.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention provides a barrier rib structure for a plasma display panel. The portions of barrier ribs in non-discharge regions are designed in form of nodes composed of two side-expanded trapezoid bulges to form small gas channels which can inhibit erroneous discharge, increase the opening ratio and improve gas purging and refilling. Moreover, the trapezoid bulges add four inclined planes or arced planes at the corners of each discharge space. The coating area for the fluorescencer in each discharge space is increased, and each coating surface can receive uniform ultraviolet rays to improve luminescence efficiency.

Figure 1:
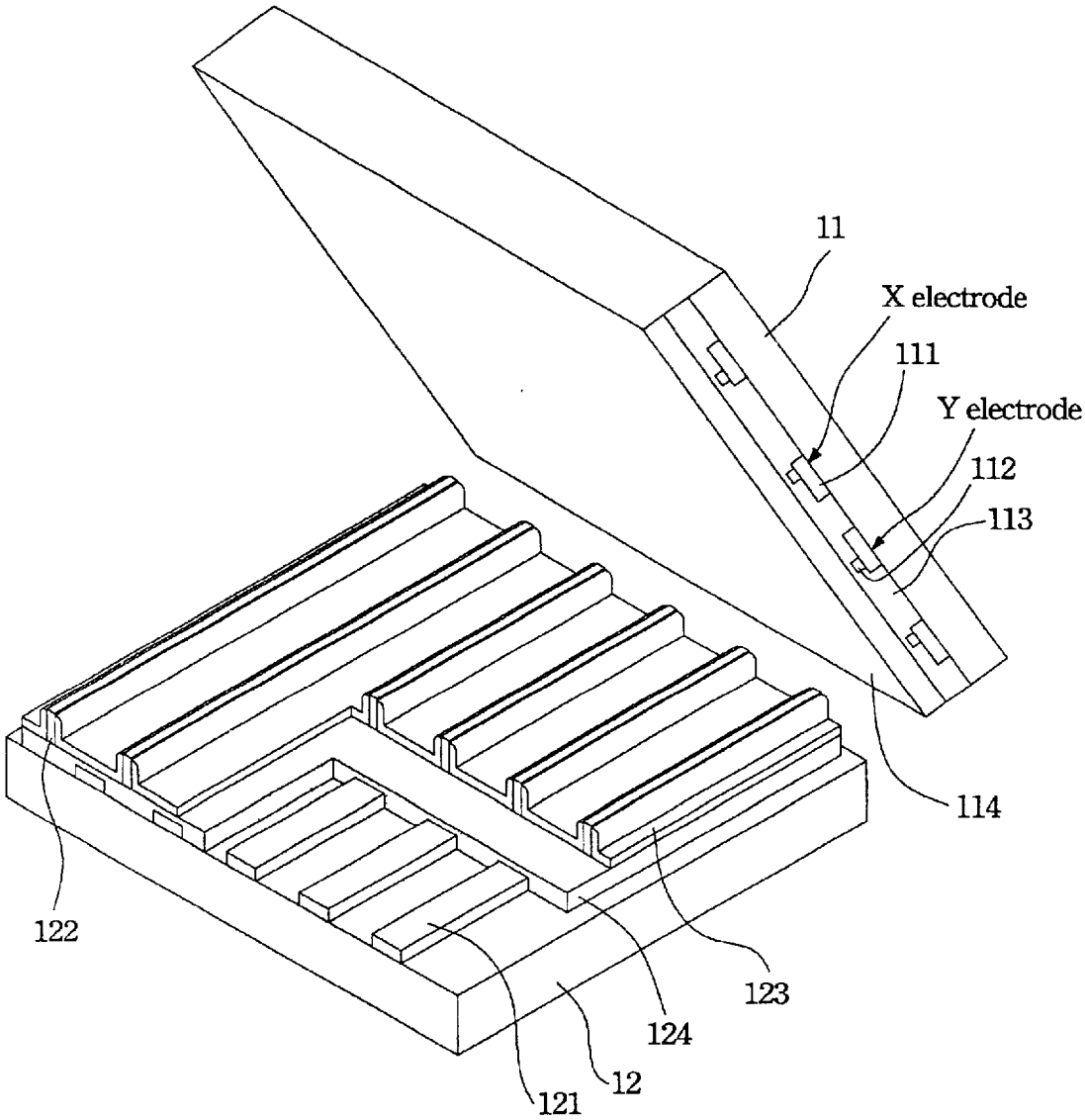
FIG. 1 (PRIOR ART)
FIG. 1 is a schematic assembly diagram of a front substrate and a back substrate of a conventional plasma display panel.
Figure 2:
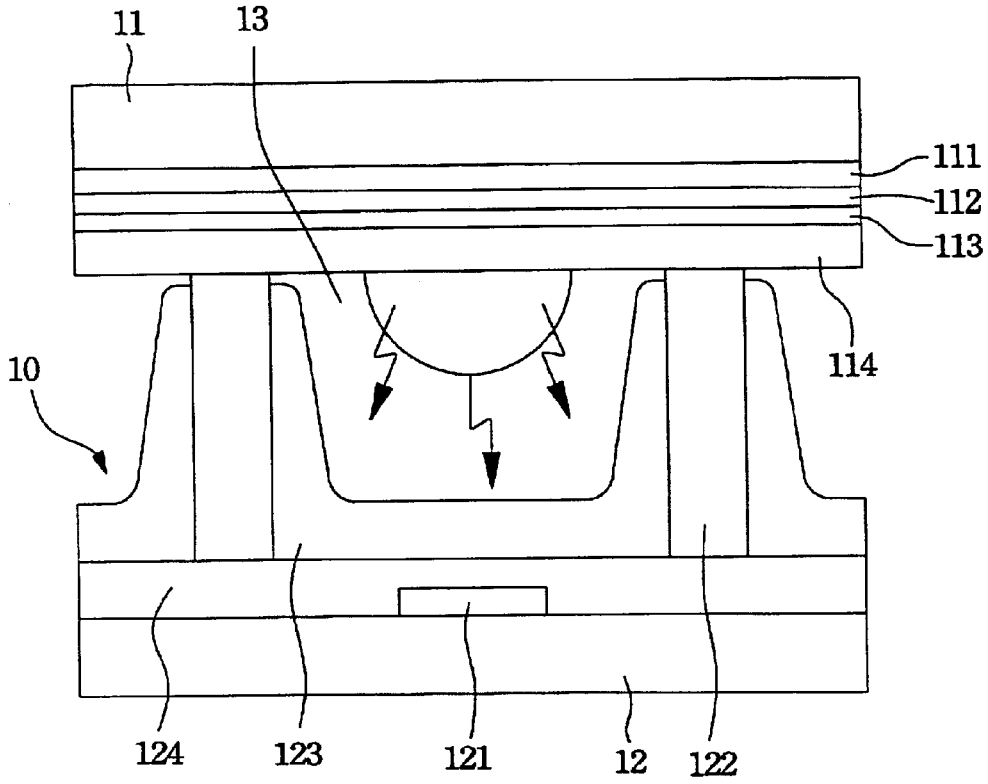
FIG. 2 (PRIOR ART)
FIG. 2 is a schematic, cross-sectional view of a conventional plasma display panel.
Figure 3:
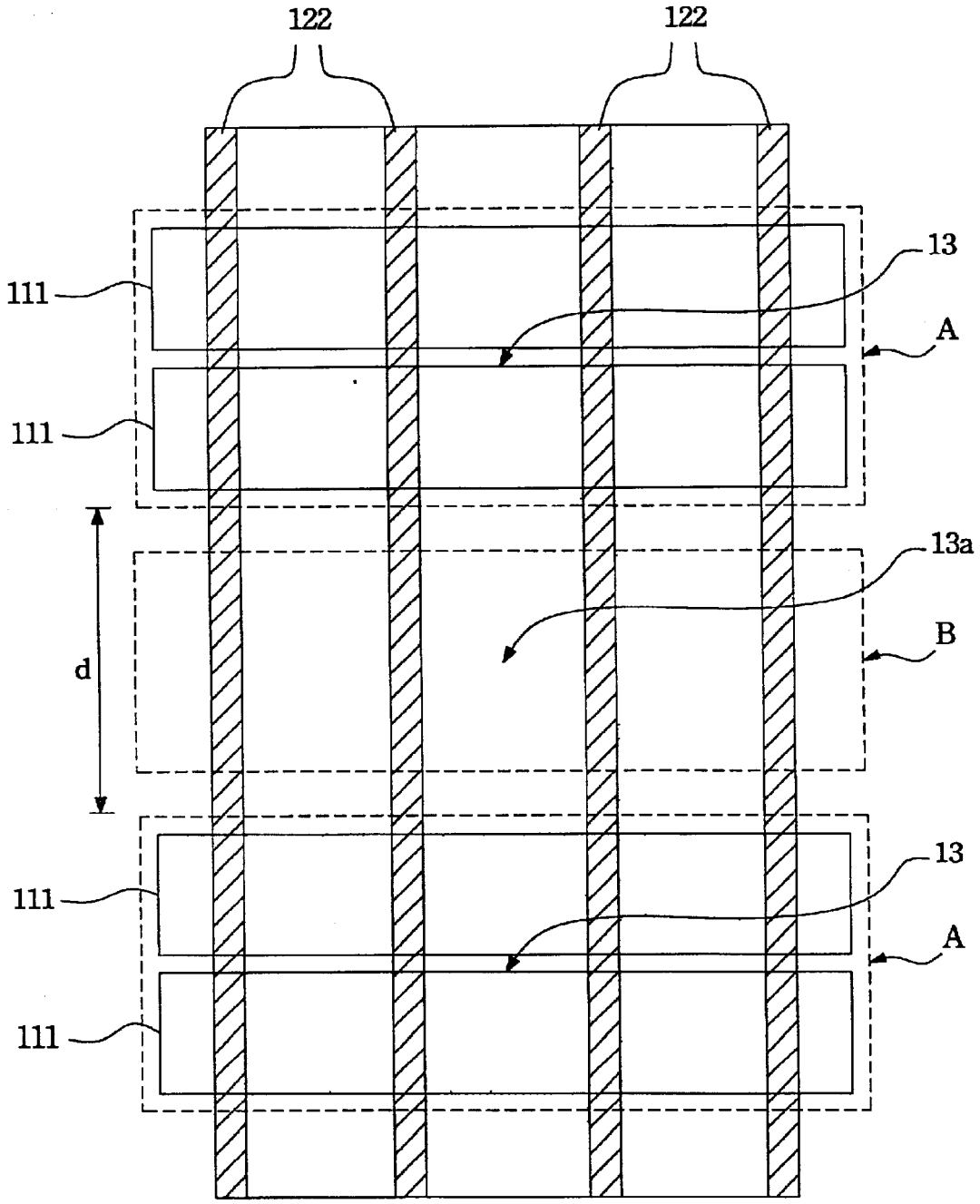
FIG. 3 (PRIOR ART)
FIG. 3 is a schematic top view of a conventional plasma display panel in the state of erroneous discharge in a non-discharge region.
Figure 4:
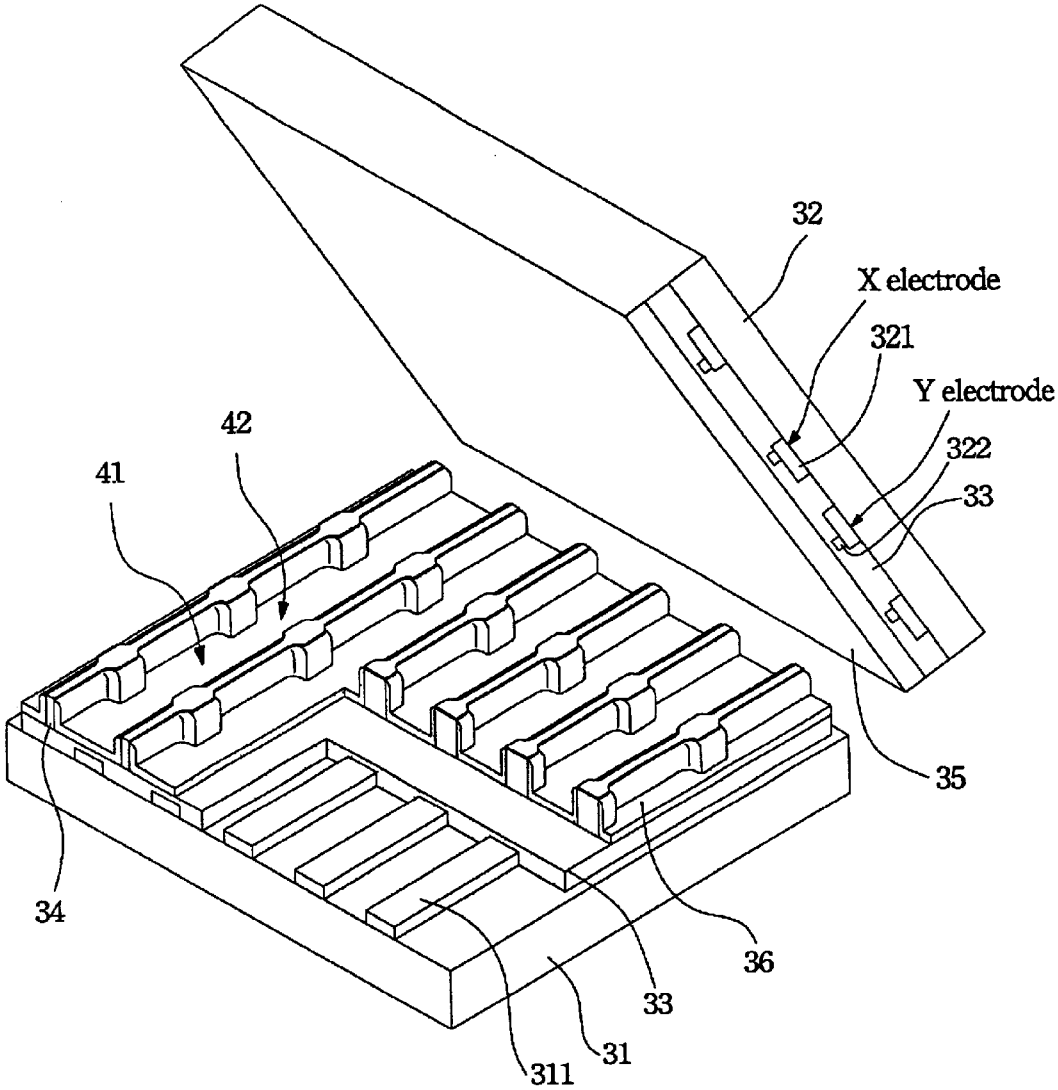
FIG. 4 is schematic assembly diagram of a plasma display panel according to one preferred embodiment of the present invention.

FIG. 4 is a schematic assembly diagram of a plasma display panel according to one preferred embodiment of the present invention. The plasma display panel (PDP) of the present invention at least comprises a front substrate 32 and a back substrate 31. A plurality of parallel-arranged address electrodes 311 are formed on the back substrate 31, and a dielectric layer 33 is formed on the back substrate 31 to cover the address electrodes 311. A plurality of parallel-arranged barrier ribs 34 respectively located between the address electrodes 311 are formed on the dielectric layer 33. That is, between two adjacent barrier ribs 34 has one address electrode 311.

On the inside surface of the front substrate 32, a plurality of parallel-arranged transparent electrodes 321, including an X electrode and an Y electrode, is formed. Each transparent electrode 321 has a bus electrode 322 thereon. A dielectric layer 33 is formed on the front substrate 32 to cover the transparent electrodes 321 and bus electrodes 322. A protective layer 35 is formed on the dielectric layer 33. When the substrates 31, 32 are combined together and the steps of vacuuming and refilling with mixed gas having a determined mixed ratio of special gas, such as He, Ne, Ar, or Xe, are completed, the address electrodes 311 on the back substrate 31 and the transparent electrodes 321 on the front substrate 32 are perpendicularly crossed to form the corresponding discharge units.

Figure 5:
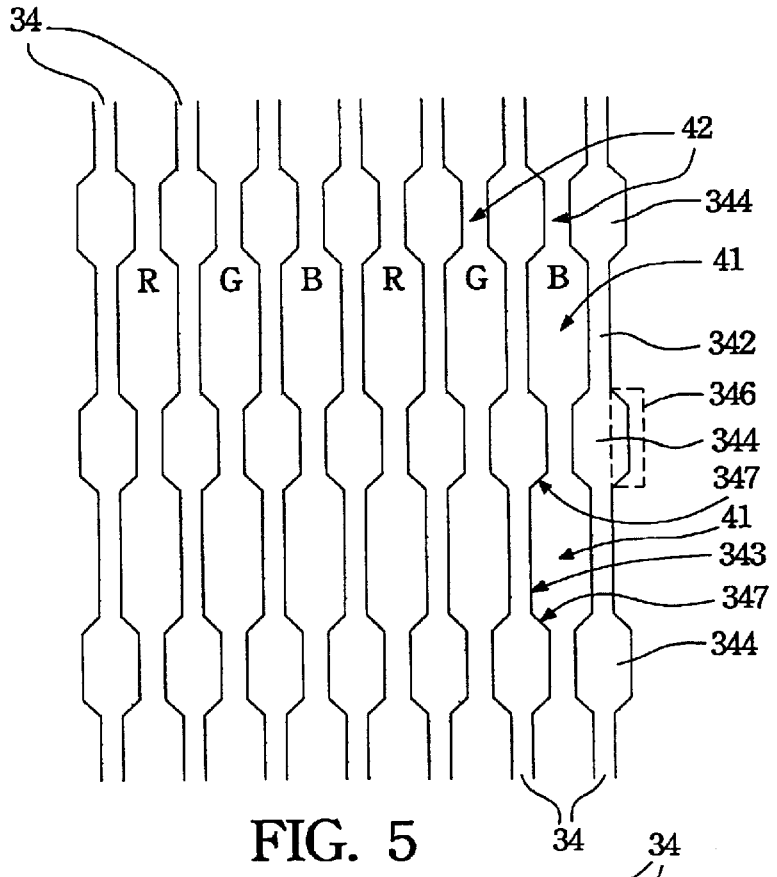
FIG. 5 is a schematic top view of a barrier rib structure on a back substrate according to one preferred embodiment of the present invention.
Figure 6:
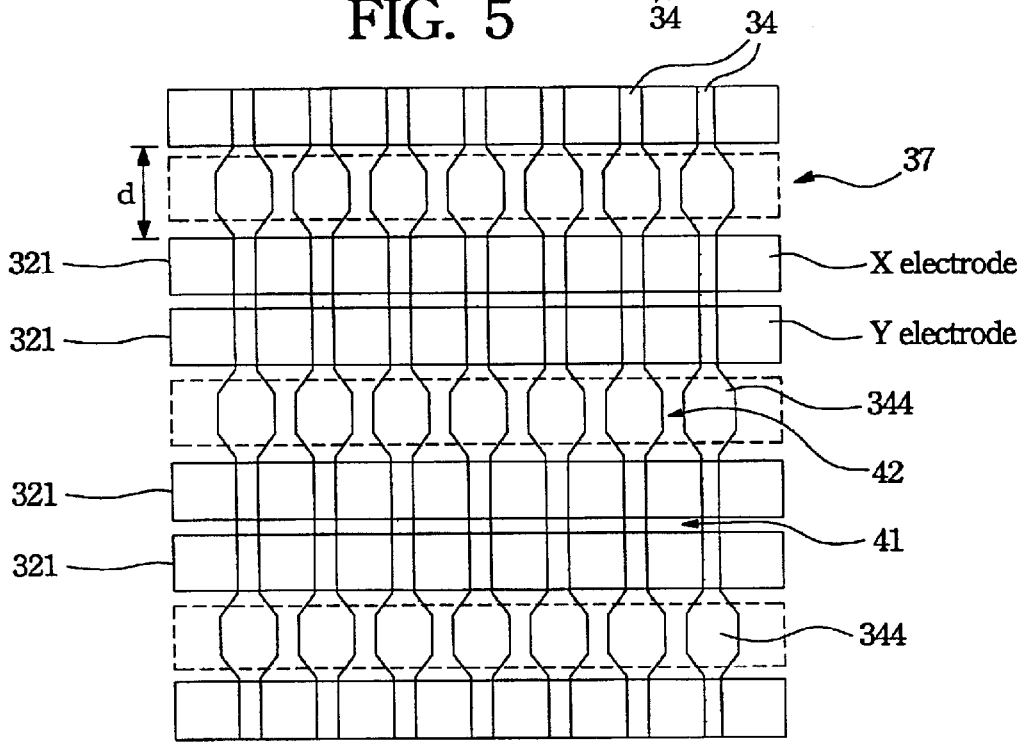
FIG. 6 is a schematic top view of a barrier rib structure coordinated with X and Y electrodes on a front substrate according to one preferred embodiment of the present invention.

Referring to FIGS. 5 and 6, a plurality of barrier ribs are set on the back substrate 31 of the present invention. The barrier ribs 34 and the address electrodes 311 are in an alternating parallel arrangement, i.e. one address electrode 311 is located between two adjacent barrier ribs 34, as shown in FIG. 4. The back substrate 31 is divided into two regions. One is a discharge region where the regions the transparent electrodes 321 are located, and the other is a non-discharge region where the regions have a distance d between the transparent electrodes 321. A plurality of nodes 344 are set in the non-discharge region of each barrier ribs 34. Each node 344 is composed of two side-expanded trapezoid bulges 346, so that each node 344 is wider than the portion of barrier rib 34 in the discharge region. Accordingly, a space is formed between the barrier ribs 34. A plurality of larger discharge space 41 are formed because of thinner barrier ribs 34 in the discharge region, and a plurality of smaller gas channels 42 are formed between the nodes 344 in the non-discharge region. The width of the gas channels 42 is about ½ to 1/20 of that of the discharge space 41 and the gas channels are used to connect adjacent discharge spaces 41. When gas discharge occurs in the discharge space 41 of each discharge unit, since the connected gas channels 42 are very small because of the side-expanded trapezoid bulges, the discharge energy is limited to the discharge space 41 to improve luminescence efficiency and effectively inhibit erroneous gas discharge. Moreover, the processes of vacuuming and refilling gas can be successfully finished while manufacturing the PDP due to the existence of the gas channels 42. Furthermore, because erroneous discharge does not occur, the width d of the non-discharge region can be shrunk to enlarge relatively the size of the discharge space 41 in the discharge region, and the opening ratio is thus increased.

In one preferred embodiment of the present invention, the barrier ribs 34 have a thinner portion 342 beside the discharge space 41 in the discharge region. Both sides of the thin portion 342 of the barrier ribs 34 are inclined planes 347 expanded to a default slope. Therefore, at each corner of each discharge space 41 has a tilted inclined plane 347 that is substantially equidistant to the center of the discharge space 41. Hence, the fluorescencer coating planes in the discharge space 41 are increased to 7 planes from the conventional 3 planes, including one bottom and two sidewall planes, in which 4 inclined planes are added to increase fluorescencer coating area. When a voltage is applied to the transparent electrodes 321 and address electrodes 311, gas discharge occurs in the discharge space 41 through the dielectric layers 33 on the front substrate 32 and back substrate 31 to generate ultraviolet rays from the mixed gas sealed therein. The ultraviolet rays light the fluorescent layer 36 inside the discharge space to produce colored lights, such as a red, green, or blue visible light. Therefore, the luminescence efficiency is increased by increasing the fluorescencer coating area.

Figure 7:
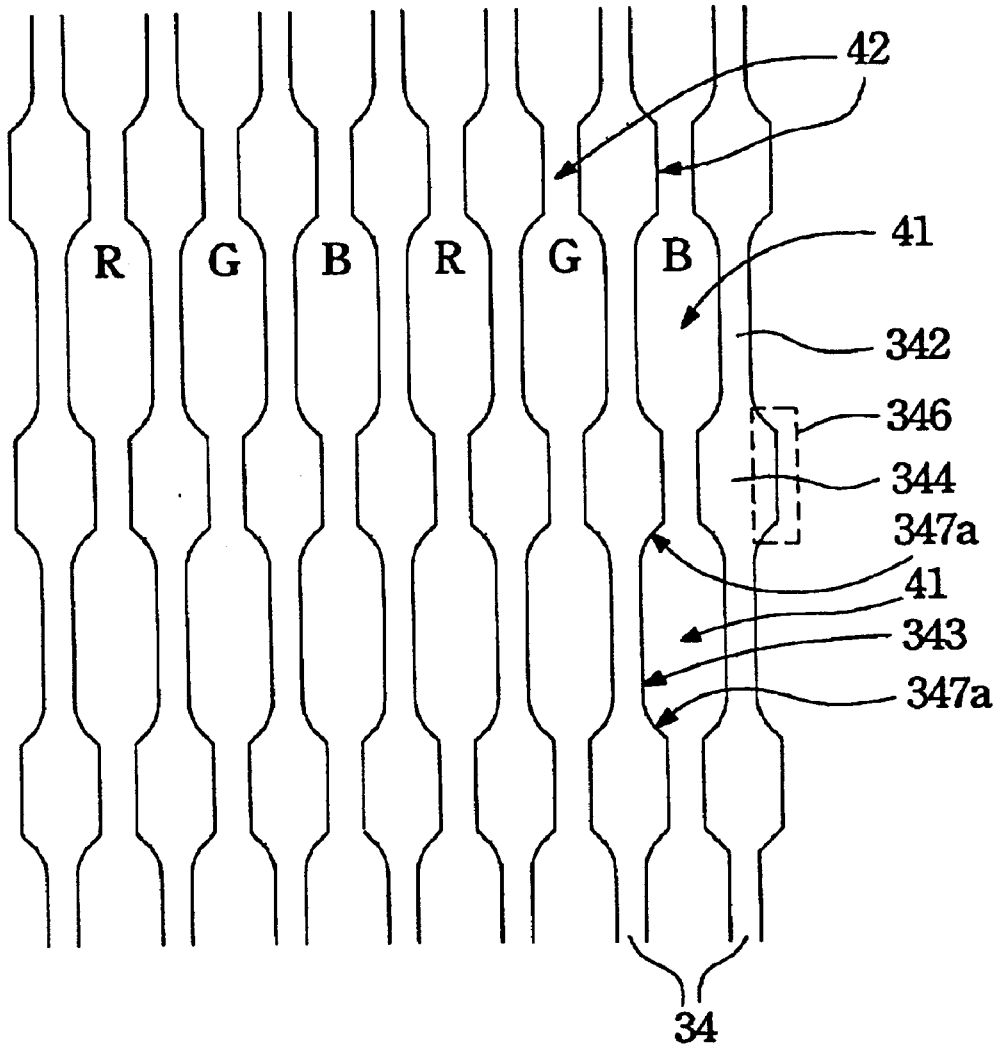
FIG. 7 is a schematic top view of a barrier rib structure of which the inclines of a trapezoid bulge are designed to have an arc profile according to another preferred embodiment of the present invention.

Referring to FIG. 7, in another preferred embodiment of the present invention, both sides of the trapezoid bulges 346 are designed to be arced planes 347*a*. The arced planes 347*a* are substantially equidistant to the center of the discharge space 41. The inclined plane 347 or arced plane 347*a* can uniformly receive ultraviolet rays during gas discharging to improve the luminescence efficiency. Moreover, the tilted angle of the inclined plane 347 or arced plane 347A can assist gas flow during the manufacture process of vacuuming and refilling mixed gas to prevent gas molecules from accumulating in the corners of the discharge space 41.

Figure 8:
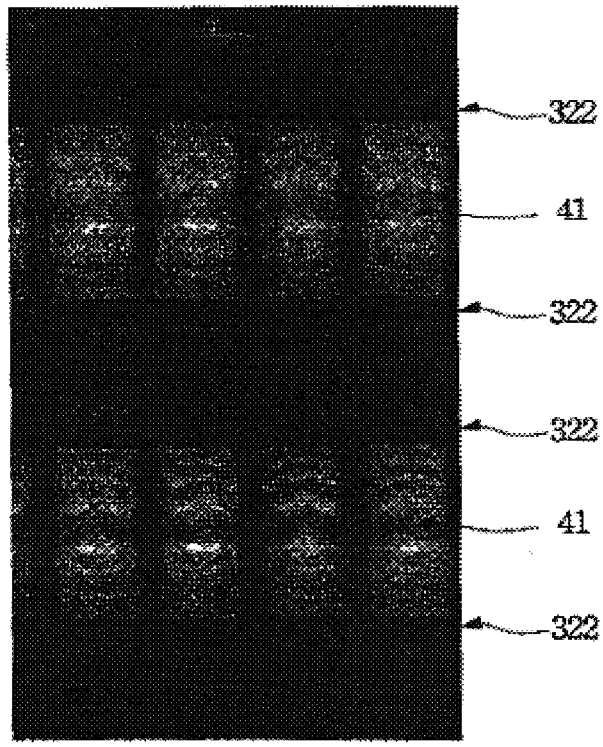
FIG. 8 is an infrared image of a barrier rib structure during gas discharge according to one preferred embodiment of the present invention.
Figure 9:
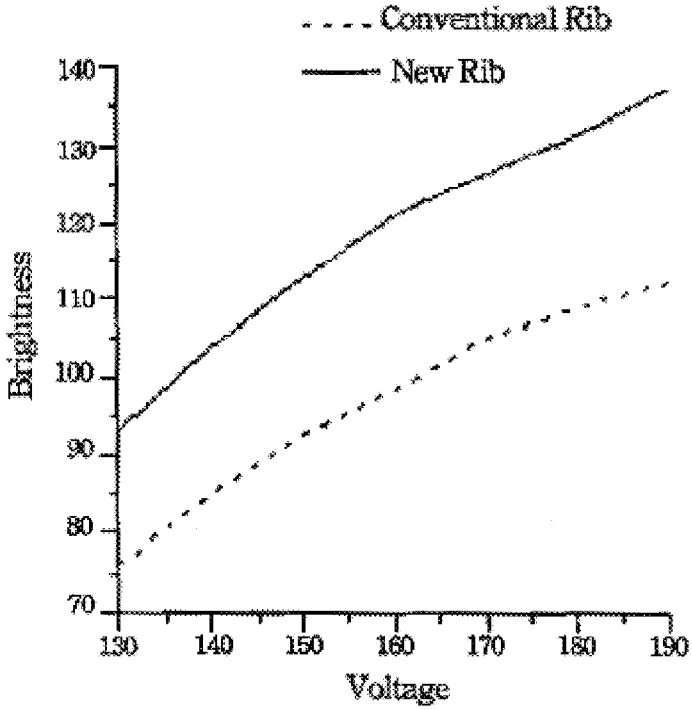
FIG. 9 is a graph comparing relative brightnesses of a conventional barrier rib structure and a barrier rib structure according to one preferred embodiment of the present invention.

FIG. 8 is an infrared image of a barrier rib structure during gas discharge according to one preferred embodiment of the present invention. As shown in FIG. 8, the discharge energy is concentrically circularly diffused from the center of the discharge space 41, and the bright portions are the wave fronts. The corners of the discharge space 41 of the present invention are designed as inclined planes 347 or arced planes 347*a*, so that the fluorescencer coated on the inclined planes 347 or arced planes 347*a* can uniformly receive the ultraviolet rays during gas discharging to emit uniform visible lights. Referring to FIG. 9, when the brightness of the conventional PDP is compared to the PDP of the present invention, the brightness of the present invention is about 10–40% higher than that of the conventional PDP.

Since the barrier ribs 34 are thicker in non-discharge regions because of nodes 344, the structure strength is enhanced and thus the portions of the barrier ribs 34 in discharge regions can be much thinner. Hence, the size of the discharge region can be enlarged, and erroneous discharge can be prevented so that the driving margin is improved. The trapezoid bulges of the barrier ribs 34 in non-discharge regions increase the thickness of the barrier ribs 34 in these regions. During the process of fabricating the barrier ribs 34, the adhesion of the photosensitive material layer to the barrier ribs 34 is enhanced because cling area is increased, so peeling of the photosensitive material layer does not occur and the yield of the product can be improved. In addition, the discharge spaces 41 between the barrier ribs 34 are arranged in columns, so that the process of printing the fluorescencer is similar to that for conventional strip barrier ribs, and the problem of disproportion and color mixing does not occur. A black-colored material or anti-reflective materials can be used in the top portion of the barrier ribs 34 to skip the process of black strip 37 while still maintaining the function thereof. Therefore, the yield can be improved and the manufacture cost can be decreased.

Figure 10:
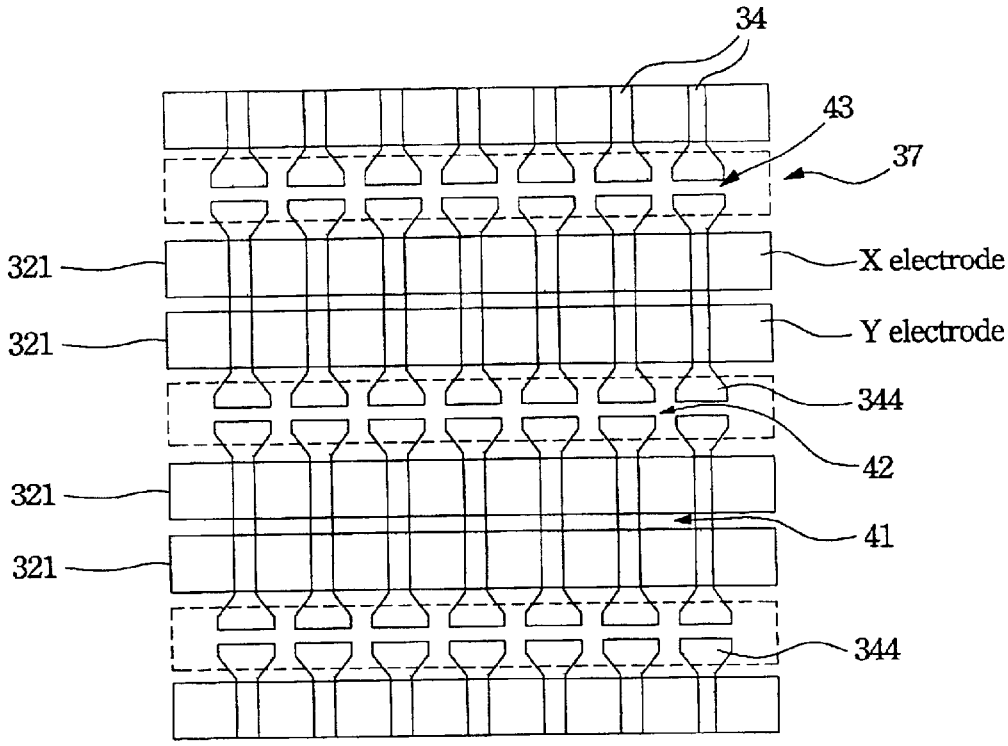
FIG. 10 is a schematic top view of a barrier rib structure having center gas channels in the nodes of non-discharge region according to a yet another preferred embodiment of the present invention.

Referring to FIG. 10, in yet another preferred embodiment of the present invention, a mid-channel 43 perpendicular to the gas channels 42 are designed in the nodes 344 to connect adjacent gas channels 42. Accordingly, a continuous straight gas channel transpierces the nodes 344 in row to assist gas purging and refilling during vacuuming and refilling gas the discharge space 41.

Figure 11:
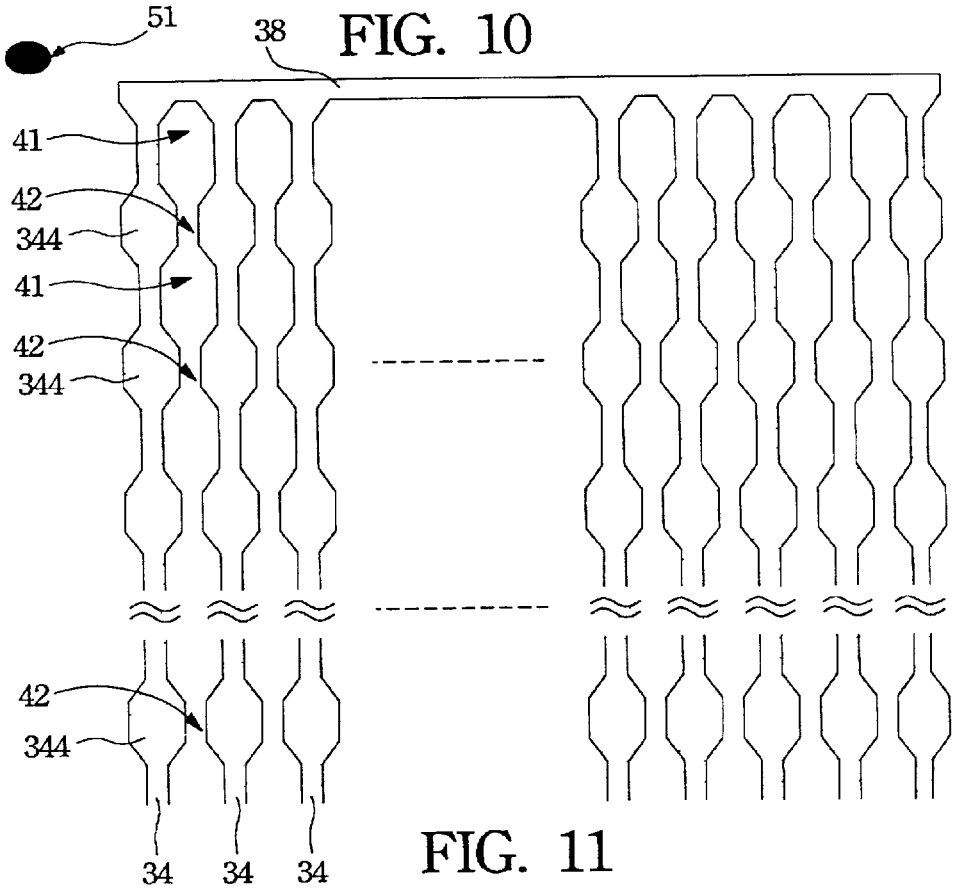
FIG. 11 is a schematic top view of a barrier rib structure having an isolation wall adjacent to a purge hole to seal the channels between barrier ribs.

Referring to FIG. 11, an isolation wall 38 perpendicular to the gas channels 42 can be set or mounted on the edge of the barrier ribs 34 array, adjacent to a purge hole that is used for vacuuming, to seal the barrier ribs 34. During the process of vacuuming, the gas between the barrier ribs 34 is purged in a reverse direction, rather than directly purging into the purge hole 51, so that no local turbulence gas flow is produced to damage the neighboring barrier ribs 34. Similarly, the refill mixed gas is injected in indirect flow path, so the barrier ribs 34 will not be damaged.

Accordingly, the present invention provides a barrier rib structure for a plasma display panel. A plurality of nodes composed of two side-expanded trapezoid bulges are located in non-discharge regions of barrier ribs to form small gas channels between the nodes such that erroneous gas discharge is prevented and gas vacuuming and refilling is assisted. Moreover, the trapezoid bulges add inclined planes or arced planes at the corners of each discharge space to increase the coating area of fluorescencer to 7 planes. The increased coating area in each discharge unit improves the luminescent brightness.

As is understood by a person skilled in the art, the foregoing preferred embodiments of the present invention are illustrative of the present invention rather than limiting of the present invention. They are intended to cover various modifications and similar arrangements included within the spirit and scope of the appended claims, the scope of which should be accorded the broadest interpretation so as to encompass all such modifications and similar structure.

What is claimed is:

1. A barrier rib structure for a plasma display panel formed on a back substrate, comprising:

a plurality of barrier ribs on said back substrate, each of said barrier ribs having a plurality of wide portions, each of said wide portions being composed of two protrudent trapezoid bulges, said barrier ribs being arranged parallel to each other with said wide portions lined up to form a plurality of discharge spaces between said barrier ribs and a plurality of gas channels between said wide portions; and a mid-channel in said wide portion perpendicular to and connected to said gas channels adjacent to said wide portion.

2. The structure according to claim 1, wherein a tilted plane of said two protrudent trapezoid bulges comprises an inclined plane.

3. The structure according to claim 1, wherein a tilted plane of said two protrudent trapezoid bulges comprises an arced plane.

4. The structure according to claim 2, wherein said inclined plane or said arced plane is substantially equidistant to the center of said discharge space.

5. The structure according to claim 1, wherein a width of said gas channel is about ½ to 1/20 of a width of said discharge space.

6. The structure according to claim 1, wherein a fluorescent layer is coated on a bottom and sidewalls of said barrier ribs inside said discharge space.

7. The structure according to claim 1, wherein said gas channels are used to vacuum and refill said discharge space with gas.

8. The structure according to claim 1, wherein a top portion of said barrier ribs is made of anti-reflective materials.

9. The structure according to claim 1, further comprising an isolation wall to seal said barrier ribs adjacent to a purge hole.

10. A gas discharge luminescent structure of a plasma display panel, comprising:

a first dielectric layer having a plurality of parallel address electrodes therein;

a plurality of barrier ribs on said first dielectric layer respectively located between said address electrodes, each of said barrier ribs having a plurality of wide portions, each of said wide portions be composed of two protrudent trapezoid bulges, said barrier ribs being parallel to each other with said wide portions lined up to form a plurality of discharge space between said barrier ribs and a plurality of gas channels between said wide portions;

a mid-channel in said wide portion perpendicular to and connected to said gas channels adjacent to said wide portion;

a fluorescent layer on the sidewalls and bottom of said discharge space; and a second dielectric layer on said barrier ribs, said second dielectric layer having a plurality of parallel transparent electrodes therein, and said transparent electrodes crossing said address electrodes over said discharge space.

11. The structure according to claim 10, wherein a tilted plane of said two protrudent trapezoid bulges comprises an inclined plane.

12. The structure according to claim 10, wherein a tilted plane of said two protrudent trapezoid bulges comprises an arced plane.

13. The structure according to claim 11, wherein said inclined plane or said arced plane is substantially equidistant to the center of said discharge space.

14. The structure according to claim 10, wherein a width of said gas channel is about ½ to 1/20 of a width of said discharge space.

15. The structure according to claim 10, wherein said gas channels are used to vacuum and refill said discharge space with gas.

16. The structure according to claim 10, wherein a top portion of said barrier ribs is made of anti-reflective materials.

17. The structure according to claim 10, wherein each of said transparent electrodes comprises an X electrode and an Y electrode.

18. The structure according to claim 17, wherein said X electrode and said Y electrode have a bus electrode, respectively.

19. The structure according to claim 10, further comprising a protective layer between said barrier ribs and said second dielectric layer.

20. The structure according to claim 10, further comprising an isolation wall to seal said barrier ribs adjacent to a purge hole.

* * * * *

UNITED STATES PATENT AND TRADEMARK OFFICE

CERTIFICATE OF CORRECTION

PATENT NO. : 6,720,732 B2
DATED : April 13, 2004
INVENTOR(S) : Kao et al.

It is certified that error appears in the above-identified patent and that said Letters Patent is hereby corrected as shown below:

Title page,
Item [73] Assignee, should read -- Chunghwa Picture Tubes Ltd., Taipei (TW) --.

Signed and Sealed this

Thirtieth Day of November, 2004

JON W. DUDAS
*Director of the United States Patent and Trademark Office*